US009919539B2

(12) United States Patent
Sugai et al.

(10) Patent No.: US 9,919,539 B2
(45) Date of Patent: Mar. 20, 2018

(54) PRINTING APPARATUS, PRINTED MATTER AND METHOD OF MANUFACTURING PRINTED MATTER

(71) Applicant: SEIKO EPSON CORPORATION, Tokyo (JP)

(72) Inventors: Keigo Sugai, Suwa (JP); Masahisa Otake, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/967,850

(22) Filed: Dec. 14, 2015

(65) Prior Publication Data

US 2016/0185130 A1 Jun. 30, 2016

(30) Foreign Application Priority Data

Dec. 24, 2014 (JP) ..... 2014-260348

(51) Int. Cl.
*B41J 11/00* (2006.01)
*B41M 7/00* (2006.01)
*B41J 2/21* (2006.01)

(52) U.S. Cl.
CPC ..... *B41J 11/002* (2013.01); *B41J 2/2114* (2013.01); *B41J 11/0015* (2013.01); *B41M 7/0081* (2013.01)

(58) Field of Classification Search
CPC ..... B41J 11/002
See application file for complete search history.

(56) References Cited

U.S. PATENT DOCUMENTS 6,550,906 B2 * 4/2003 Ylitalo ..... B41J 11/002 347/102
2002/0122106 A1 * 9/2002 Ylitalo ..... B41J 3/28 347/102
2008/0117246 A1 5/2008 Hoshino
2011/0134179 A1 * 6/2011 Otsuka ..... B41J 11/002 347/16
2012/0147077 A1 * 6/2012 Usuda ..... B41J 2/2117 347/12
2012/0327147 A1 * 12/2012 Okawa ..... B41J 2/2114 347/9

(Continued)

FOREIGN PATENT DOCUMENTS

CN 101607470 A * 12/2009
JP 2006-150788 A 6/2006

(Continued)

*Primary Examiner* — Shelby Fidler
(74) *Attorney, Agent, or Firm* — Workman Nydegger

(57) ABSTRACT

A printing apparatus that prints an image while forming a layered body, which has a layered structure in which a plurality of ink layers formed by applying a photocurable ink is layered and at least a portion of the plurality of ink layers is an image layer, on a printing medium, is provided with a first ink layer forming section that coats a printing medium with a first photocurable ink that configures a lowermost layer of the plurality of ink layers to form the lowermost layer, and causes the lowermost layer to be cured while irradiating the lowermost layer with light after at least three seconds elapse; and a second ink layer forming section that applies an ink layer other than the lowermost layer after the first photocurable ink is cured.

9 Claims, 12 Drawing Sheets

(56) References Cited

U.S. PATENT DOCUMENTS

| | | | | |
|---|---|---|---|---|
| 2014/0002560 | A1* | 1/2014 | Ohkawa | B41J 2/01 347/102 |
| 2015/0183234 | A1* | 7/2015 | Cluff | B41M 7/0045 347/102 |
| 2015/0328908 | A1* | 11/2015 | Hatanaka | B41J 11/002 347/16 |

FOREIGN PATENT DOCUMENTS

| | | | | |
|---|---|---|---|---|
| JP | 2008-087246 | A | | 4/2008 |
| JP | 2010005934 | A | * | 1/2010 |

* cited by examiner

FIG. 8

| SCANNING NUMBER | AREA | LINE IMAGE | DISCHARGE Duty |
|---|---|---|---|
| 1 | FIRST AREA AR1 | A11 | 60% |
| 2 | SECOND AREA AR2 | A21 | 60% |
| 3 | FIRST AREA AR1 | B11 | 70% |
| 4 | SECOND AREA AR2 | B21 | 70% |
| 5 | FIRST AREA AR1 | C11 | 80% |
| 6 | SECOND AREA AR2 | C21 | 80% |
| 7 | FIRST AREA AR1 | D11 | 90% |
| 8 | SECOND AREA AR2 | D21 | 90% |
| 9 | FIRST AREA AR1 | A12 | 40% |
| 10 | SECOND AREA AR2 | A22 | 40% |
| 11 | FIRST AREA AR1 | B12 | 30% |
| 12 | SECOND AREA AR2 | B22 | 30% |
| 13 | FIRST AREA AR1 | C12 | 20% |
| 14 | SECOND AREA AR2 | C22 | 20% |
| 15 | FIRST AREA AR1 | D12 | 10% |
| 16 | SECOND AREA AR2 | D22 | 10% |

| COMPATIBILIZING TIME | ADHESIVENESS | DETERMINATION |
|---|---|---|
| 0.5 [s] | 0/100 | × |
| 1.0 [s] | 23/100 | × |
| 3.0 [s] | 89/100 | ○ |
| 6.0 [s] | 100/100 | ◎ |
| 12 [s] | 100/100 | ◎ |
| 20 [s] | 100/100 | ◎ |
| 30 [s] | 95/100 | ○ |
| 45 [s] | 78/100 | ○ |
| 60 [s] | 9/100 | × |

PRINTING APPARATUS, PRINTED MATTER AND METHOD OF MANUFACTURING PRINTED MATTER

BACKGROUND

1. Technical Field

The present invention relates to a printing technology that layers a plurality of ink layer formed by applying a photocurable ink on a printing medium, thereby forming an image.

2. Related Art

The apparatus disclosed in JP-A-2006-150788 (below, referred to as "apparatus of the related art") is an example of a printing apparatus that forms an image on a printing medium using a photocurable ink. The apparatus of the related art has a recording head (corresponding to the "print head" of the invention) and an ultraviolet ray light source (corresponding to the "light radiating section" of the invention) mounted on a carriage that is freely movable in a main scanning direction. In the apparatus of the related art, a photocurable ink is discharged from the recording head onto a printing medium while the carriage moves in the main scanning direction, thereby forming an image and the image is cured while being irradiated with light from the ultraviolet ray light source, thereby fixing the image to the printing medium.

A technology that uses a transparent thermoplastic resin sheet as the printing medium, and manufactures a printed matter deeply drawing worked into a half-cut shape of a beverage commodity container after decoration printing is carried out by a printing apparatus such as the apparatus of the related art is proposed in the related art (refer to JP-A-2008-87246).

In the apparatus of the related art, the ultraviolet ray light source is arranged neighboring the recording head in the main scanning direction and moves integrally with the recording head in the main scanning direction. Therefore, after the ink discharged from the recording head lands on the printing medium, thereby forming the ink dots, the ink dots are irradiated with ultraviolet rays from the ultraviolet ray light source for at most approximately one second and at least 0.1 seconds. Because the time until the ink is cured in this way is short, in particular, in a case of using a medium with a comparatively high chemical resistance, such as a polycarbonate, as the printing medium, a problem arises in which a compatible layer in which the ink and the printing medium melt into one another is not sufficiently formed, and the adhesive force of the ink to the printing medium is weak.

When various processes are carried out on the printing medium subjected to decoration printing in a state where the adhesive force is weak, the ink may have difficulty ion tracking the expansion when the printing medium is expanded due to the processing, and the ink layer may be damaged.

SUMMARY

An advantage of some aspects of the invention is to provide a printing technology that is able to increase the adhesive force of a photocurable ink to the printing medium, a method of favorably manufacturing a printed matter using the printing technology, and a printed matter without damage to the ink layer.

According to a first aspect of the invention, there is provided a printing apparatus that prints an image while forming a layered body, which has a layered structure in which a plurality of ink layers formed by applying a photocurable ink is layered and at least a portion of the plurality of ink layers is an image layer, on a printing medium, the printing apparatus including a first ink layer forming section that coats the printing medium with a first photo curable ink that configures a lowermost layer of the plurality of ink layers to form the lowermost layer, and causes the lowermost layer to be cured while irradiating the lowermost layer with light after at least three seconds elapse; and a second ink layer forming section that applies an ink layer other than the lowermost layer after the first photocurable ink is cured.

According to a second aspect of the invention, a method of manufacturing a printed matter, including printing an image by forming a layered body, which has a layered structure in which a plurality of ink layers formed by applying a photocurable ink is layered and at least a portion of the plurality of ink layers is an image layer, on a printing medium; and molding the printing medium on which the image is printed, in which the printing of the image includes coating the printing medium with a first photocurable ink that configures a lowermost layer of the plurality of ink layers to form the lowermost layer, and causing the lowermost layer to be cured while irradiating the lowermost layer with light after at least three seconds elapse, applying an ink layer other than the lowermost layer after the first photocurable ink is cured, and causing the ink layer other than the lowermost layer to be cured.

According to a third aspect of the invention, there is provided a printed matter manufactured with the method of manufacturing a printed matter.

In the invention configured in this way, a compatible layer sufficient for melting the ink that configures the lowermost layer, that is the first photocurable ink and the printing medium into one another while three or more seconds elapse from the formation of the lowermost layer on the printing medium, and causing the lowermost layer and the printing medium to adhere to each other. The lowermost layer is cured while the lowermost layer is irradiated with light after formation of the compatible layer. Another ink layer is further layered on the cured lowermost layer, and a layered body including the image layer is thereby formed on the printing medium. In this way, it is possible for the adhesive force of the ink to the printing medium to be increased, and for the image to be stably supported on the printing medium.

Although the standby time in which standby is maintained from formation of the lowermost layer to the start of irradiation of the lowermost layer with light is made three seconds or more, this corresponds to the time necessary for the first photocurable ink to melt the printing medium as described in detail later. On the other hand, when the standby time is lengthened, coagulation of the compatible layer becomes difficult, and conversely, the adhesive force between the printing medium and the lowermost layer may be lowered. Therefore, it is preferable that the lowermost layer is cured from the time of the coating of the printing medium with the first photocurable ink until 45 seconds elapse.

It is possible for each ink layer to be stabilized by curing the ink layer other than the lowermost layer through irradiation with light, and it is possible for the image on the printing medium to be made stable.

According to another aspect of the invention, a printing apparatus, for example, may be configured to include a print head that applies the photocurable ink on the printing medium to form the ink layer; a light radiating section that causes the photocurable ink to be cured while irradiating the photocurable ink applied by the print head with light; a carriage that holds the print head and the light radiating section; a movement section that moves the carriage in a main scanning direction; and an radiation controller that controls radiation and stopping of radiation of light by the light radiating section, in which the radiation controller stops the radiation of light from the light radiating section while the first photo curable ink that configures the lowermost layer of the plurality of ink layers is applied on the printing medium by the print head that moves in the main scanning direction, and causes light to be radiated from the light radiating section that moves in the main scanning direction and causes the lowermost layer to be cured after application of the first photocurable ink on the printing medium.

In the printing apparatus configured in this way, the print head and the light radiating section move integrally in the main scanning direction by the carriage being moved in the main scanning direction. Therefore, when light is radiated from the light radiating section together with the application of the first photocurable ink by the print head moving in the main scanning direction, curing of the lowermost layer is started in a comparatively short time, similarly to the apparatus of the related art. In the invention, the radiation of light from the light radiating section is stopped while the printing medium is coated with the first photocurable ink. After the printing medium is coated with the first photocurable ink, curing of the lowermost layer is performed while light is radiated from the light radiating section moving in the main scanning direction. By the radiation and the stopping of the radiation of light on the lowermost layer being controlled in this way, the first photocurable ink and the printing medium melt into one another and a compatible layer sufficient for causing the lowermost layer and the printing medium to adhere to each other is formed. As a result, similarly to the printing apparatus according to the first aspect of the invention, it is possible for the adhesive force of the ink to the printing medium to be increased and for the image to be stably supported on the printing medium.

It is desirable that the illuminance of light with which the lowermost layer is irradiated is set to the illuminance of light with which the ink layer other than the lowermost layer is irradiated or less. This is because when the lowermost layer is irradiated with light with a comparatively high illuminance, an ink film is formed on the lowermost layer, and there is a possibility of wrinkles occurring due to curing shrinkage.

The suitable value for the standby time may differ according to the type of printing medium. Therefore, it is desirable that standby time information in which a standby time is associated with each type of printing medium in advance is obtained. It is suitable to derive the standby time corresponding to the type of printing medium receiving the printing processing in practice based on the standby time information, and start irradiation of the lowermost layer after standby is maintained for the standby time. Thereby, it is possible to suitably form the compatible layer, and it is possible to optimize the adhesive force of the photo curable ink to the printing medium.

The layered structure of the layered body is arbitrary, and a structure in which an image layer is layered on the ground layer or a structure in which only a plurality of image layers is layered may be used. In a case of having a ground layer among these, the ground layer corresponds to the "lowermost layer", and in a case of having only a plurality of image layers, the lowermost layer thereamong corresponds to the "lowermost layer".

It is possible to use a material that forms ink dots while being discharged to the printing region of the printing medium and is cured as the ink, and, for example, using a liquid that cures when irradiated with ultraviolet rays is suitable.

BRIEF DESCRIPTION OF THE DRAWINGS

The invention will be described with reference to the accompanying drawings, wherein like numbers reference like elements.

FIG. 8 is a drawing showing an example of a printing process using the printing apparatus shown in FIG. 2.

DESCRIPTION OF EXEMPLARY EMBODIMENTS

Below, the first and second embodiments of the invention will be described with reference to the drawings. In each of the following drawings, because each line image and each member is given a visually recognizable size, the measurements of each line image and each member is shown made different to those used in practice.

Figure 1:
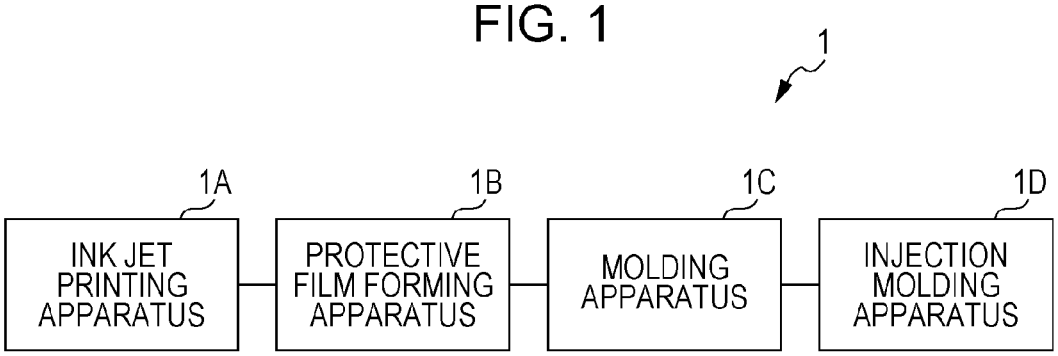
FIG. 1 is a drawing showing a system of manufacturing a printed matter to which a first embodiment of the printing apparatus according to the aspect of the invention is equipped.

FIG. 1 is a drawing showing a system of manufacturing a printed matter in which a first embodiment of the printing apparatus according to the invention is equipped. The manufacturing system 1 includes an ink jet printing apparatus 1A, a protective film forming apparatus 1B, a molding apparatus 1C, and an injection molding apparatus 1D, and a printing medium or a printed matter is transported between the apparatuses 1A to 1D by a transport apparatus, not shown in the drawings. The printing apparatus 1A among these apparatuses is an apparatus that includes an ink set that includes ultraviolet ray curable inks with seven mutually differing colors, a print head that discharges ink from the ink set as droplets, and an ultraviolet ray radiating section that radiates ultraviolet rays. The printed matter is manufactured while printing an image on the printing medium by a control section controlling the driving of the various members.

Meanwhile, the remaining apparatuses 1B to 1D carry out various post-treatments on the printing medium printed by the ink jet printing apparatus 1A, and are so-called printing post-processing apparatuses. The protective film forming apparatus 1B among these apparatuses protects the printing medium on which the desired image is printed, that is, an image printed while carrying out a surface working process such as coating work or laminating work. The molding apparatus 1C molds the surface-worked printed matter into a desired shape. The injection molding apparatus 1D injects a resin into the printed matter subjected to molding. The printed matter that receives the resin injection molding in this way is referred to a "molded article" in the specification. It is possible for apparatuses frequently used in the related art to be used as these printing post-processing apparatuses 1B to 1D.

Below, description is provided centering on the configuration of the ink jet printing apparatus 1A and the operation of the manufacturing system 1, and a detailed description pertaining to the configurations of the printing post-processing apparatuses 1B to 1D known in the related art will not be provided.

Figure 2:
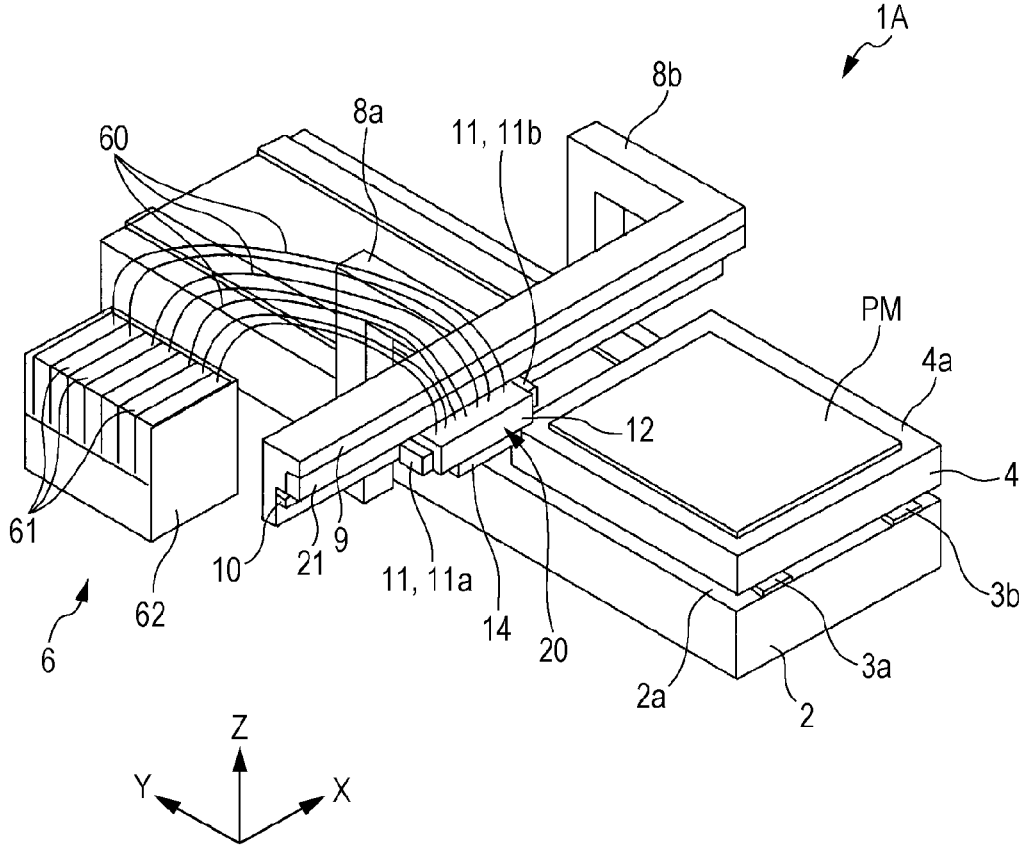
FIG. 2 is a drawing showing an ink jet printing apparatus that is the first embodiment of the printing apparatus.
Figure 3:
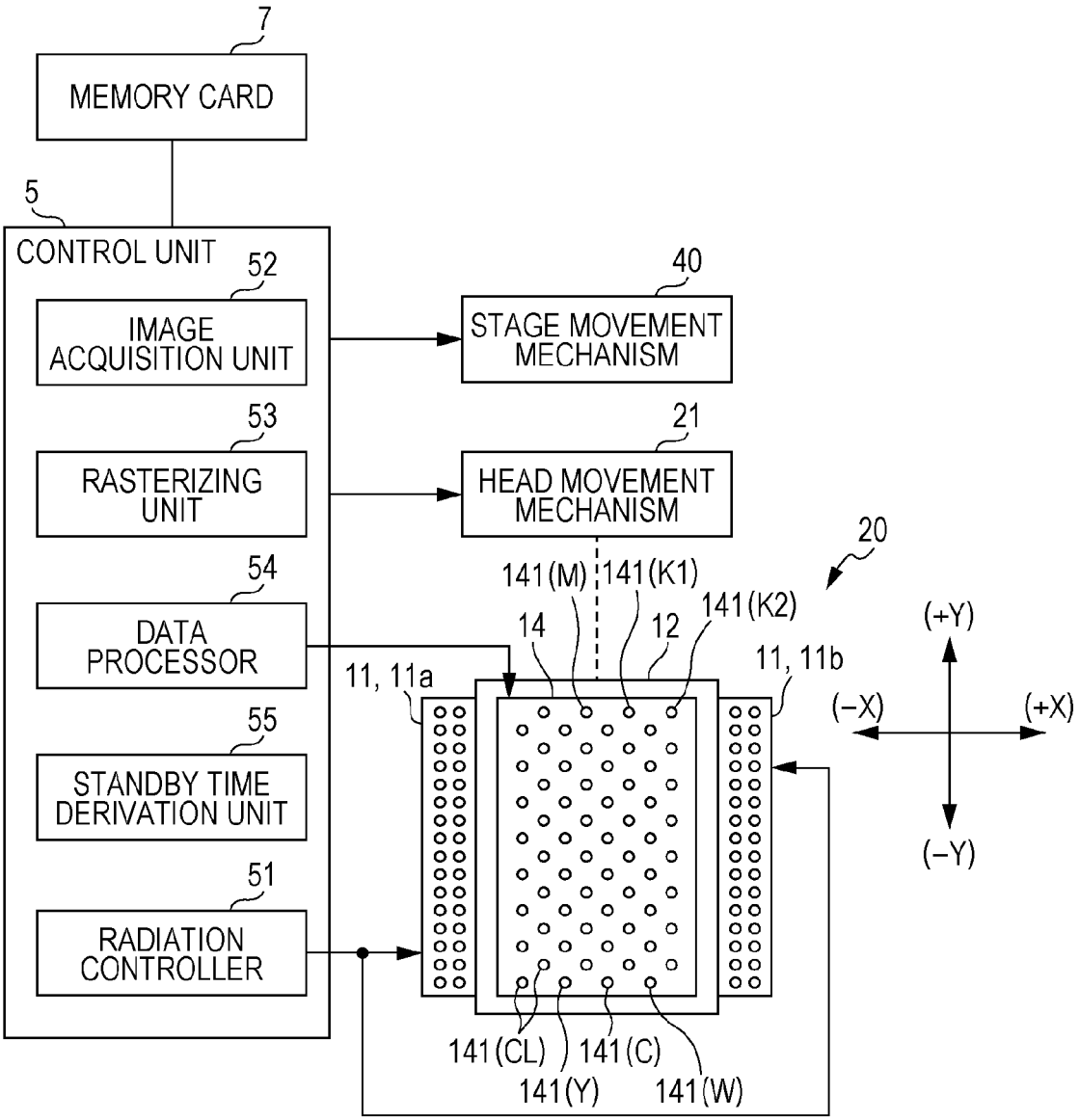
FIG. 3 is a schematic drawing showing a head and electrical configuration of the printing apparatus shown in FIG. 2.

FIG. 2 is a drawing showing an ink jet printing apparatus that is the first embodiment of the printing apparatus. FIG. 3 is a schematic drawing showing a head and electrical configuration of the ink jet printing apparatus shown in FIG. 2. As shown in FIG. 2, a base 2 formed in a rectangular parallelepiped is provided in the ink jet printing apparatus 1A. In the embodiment, the length direction of the base 2 is the Y-axis direction, and the direction orthogonal to the Y-axis direction is the X-axis direction.

A pair of guide rails 3*a* and 3*b* extending in the Y-axis direction is provided along the entire width in the Y-axis direction on the upper surface 2*a* of the base 2. A stage 4 is provided on the upper side of the base 2 to freely reciprocate in the Y-axis direction by the pair of guide rails 3*a* and 3*b*. A stage movement mechanism 40 is connected to the stage 4. It is possible to use a screw-type linear motion mechanism provided with a screw shaft (drive shaft) extending along the guide rails 3*a* and 3*b* in the Y-axis direction, a Y-axis motor (not shown) by which the screw shaft is rotated, and a ball nut screwed to the screw shaft as the stage movement mechanism 40. When a drive signal corresponding to a predetermined number of steps is input from the control section 5 to the Y-axis motor, the Y-axis motor is forward driven or reversely driven, and the stage 4 moves forward or returns at a predetermined speed along the Y-axis direction (scans in the Y-axis direction) by an amount corresponding to the number of steps.

A mounting surface 4*a* to which the printing medium PM is mounted is formed on the upper surface of the stage 4. The invention is configured such that a suction-type work chuck mechanism is provided on the mounting surface 4*a*, and the printing medium PM is fixed to a predetermined position. Although the material of the printing medium PM is not particularly limited, and it is suitable to use a sheet configured by a material that takes receiving the molding process and the injection molding process into consideration, for example, a copolymer synthetic resin of acrylonitrile, butadiene, and styrene as the printing medium PM.

One of a pair of support stands 8*a* and 8*b* is arranged upright on both sides of the base 2 in the X-axis direction. A guide member 9 extending in the X-axis direction is installed across the pair of support stands 8*a* and 8*b*. The guide member 9 is formed to be longer than the width of the stage 4 in the X-axis direction. A guide rail 10 extending in the X-axis direction is provided on the lower side of the guide member 9 across the entire width in the X-axis direction.

A head 20 that includes a carriage 12 that is movable along the guide rail 10 is provided. The head movement mechanism 21 is connected to the head 20 (carriage 12). It is possible to use a similar configuration to the stage movement mechanism 40 as the head movement mechanism 21. That is, it is possible to use a screw-type linear motion mechanism provided with a screw shaft (drive shaft) extending along the guide rail 10 in the X-axis direction, an X-axis motor (not shown) by which the screw shaft is rotated, and a ball nut screwed to the screw shaft. When a drive signal corresponding to a predetermined number of steps is input from the control section 5 to the X-axis motor, the X-axis motor is forward driven or reversely driven, and carriage 12 of the head 20 moves forward or returns at a predetermined speed along the X-axis direction (scans in the X-axis direction) by an amount corresponding to the number of steps. In the specification, the (+X) axis direction is the "forward direction" of the head 20, and the operation that prints according to the forward movement of the head 20 as described layer is referred to as the "forward printing"; meanwhile the (−X) axis direction is the "backward direction" of the head 20, and the operation that prints according to the backward movement of the head 20 as described later is referred to as the "backward printing".

In this way, the print head 14 is mounted to the carriage 12 moved in the X-axis direction. The print head 14 is connected to the ink set 6 via a pipe 60, and is supplied with ink. The ink set 6 is the supply source of a liquid in which curing is promoted by irradiation with ultraviolet rays, that is, an ultraviolet ray curable ink. A color ink that includes a pigment as a colorant and an ultraviolet ray curable resin component and a clear ink that does not include a colorant are prepared as ultraviolet ray curable inks. These inks are stored in respective ink containers 61. The plurality of ink containers 61 is accommodated in a housing holder 62. Each ink container 61 and print head 14 corresponding to each ink container 61 are connected by a pipe 60, and are configured so that ink in the ink containers 61 is able to be supplied to the print head 14. In the embodiment, ink containers 61 in which each of cyan (C), magenta (M), yellow (Y), a first black (K1), a second black (K2), and white (W) inks for a total of five colors are respectively accommodated, and an ink container 61 in which a clear ink (CL) is accommodated are used. However, the number of colors of ink or the types of ink can be variously modified.

Next, the configuration of the head 20 will be described. As shown in FIGS. 2 and 3, the head 20 is provided with a print head 14 that discharges various inks mounted to the ink set 6 as liquid droplets, and ultraviolet ray radiating sections 11 that radiate ultraviolet rays. In the embodiment, the ultraviolet ray radiating sections 11*a* and 11*b* area respectively arranged on both sides of the print head 14 (carriage 12) in the X-axis direction. The ultraviolet ray radiating sections 11*a* and 11*b* include a light source that emits ultraviolet rays. It is possible for the various light sources, such as an LED, an LD, a mercury lamp, a metal halide lamp, a xenon lamp, and an excimer lamp to be applied as the light source. When a lighting command is provided from the radiation controller 51 of the control section 5 to the ultraviolet ray radiating section 11*a*, the light source of the ultraviolet ray radiating section 11*a* is lit, and ultraviolet rays are radiated toward the mounting surface 4*a* (printing medium PM) of the stage 4. Meanwhile, when a lighting command is provided from the radiation controller 51 to the ultraviolet ray radiating section 11*b*, the light source of the ultraviolet ray radiating section 11*b* is lit, and ultraviolet rays are radiated toward the mounting surface 4*a* (printing medium PM) of the stage 4. In this way, in the embodiment, it is possible for ultraviolet rays to be generated from the two ultraviolet ray radiating sections 11*a* and 11*b* selectively or at the same time, and for curing by the ultraviolet rays of the ultraviolet ray curable ink applied on the printing medium PM to be promoted.

The print head 14 includes a plurality of nozzles 141 in the surface facing the mounting surface 4*a* (printing medium PM) of the stage 4, as shown in FIG. 3. The plurality of nozzles 141 configures nozzle rows 142 (a clear first nozzle row (CL), a clear second nozzle row, a yellow nozzle row, a magenta nozzle row, a cyan nozzle row, a first black nozzle row, a white nozzle row, and a second black nozzle row) lined up substantially parallel to the transport direction Y of the printing medium PM. The nozzle density of each nozzle row is 180 (dpi), and nozzles rows neighboring each other are arranged in a zig-zag pattern shifted in the Y-axis direction by the distance of half the pitch of the nozzle pitch. Therefore, forming the ink dots with a resolution of 360 (dpi) when the clear ink is applied using the clear first nozzle row and the clear second nozzle row, and forming ink dots with a resolution of 180 (dpi) when inks other than clear are applied are possible. In the embodiment, the print head 14 performed forward printing according to the movement of the head 20 in the forward direction (+X); meanwhile, the print head 14 performs backward printing according to the movement of the head 20 in the backward direction (−X).

The control section 5 is configured by a CPU, a ROM, RAM, and EEPROM, not shown, being connected one another with a bus. The control section 5 functions as a controller that controls the operations of each part of the ink jet printing apparatus 1A (for example, the stage movement mechanism 40, print head 14 or the like) by expanding and executing programs stored in the ROM or EEPROM in the RAM. The control section 5, other than functioning as a radiation controller 51 that controls the ultraviolet ray radiating sections 11 as described above, also functions as an image acquisition section 52, a rasterizer section 53, a data processor 54, and a standby time derivation section 55. The processes that each of the functional units performs are described later. At least a portion of the functions realized by the CPU may be realized by an electrical circuit provided in the control section 5 operating based on the circuit configuration thereof. Reference numeral 7 in FIG. 3 is a memory card that stores the print source data (for example, vector data) pertaining to the image to be printed on the printing medium PM.

Figure 4:
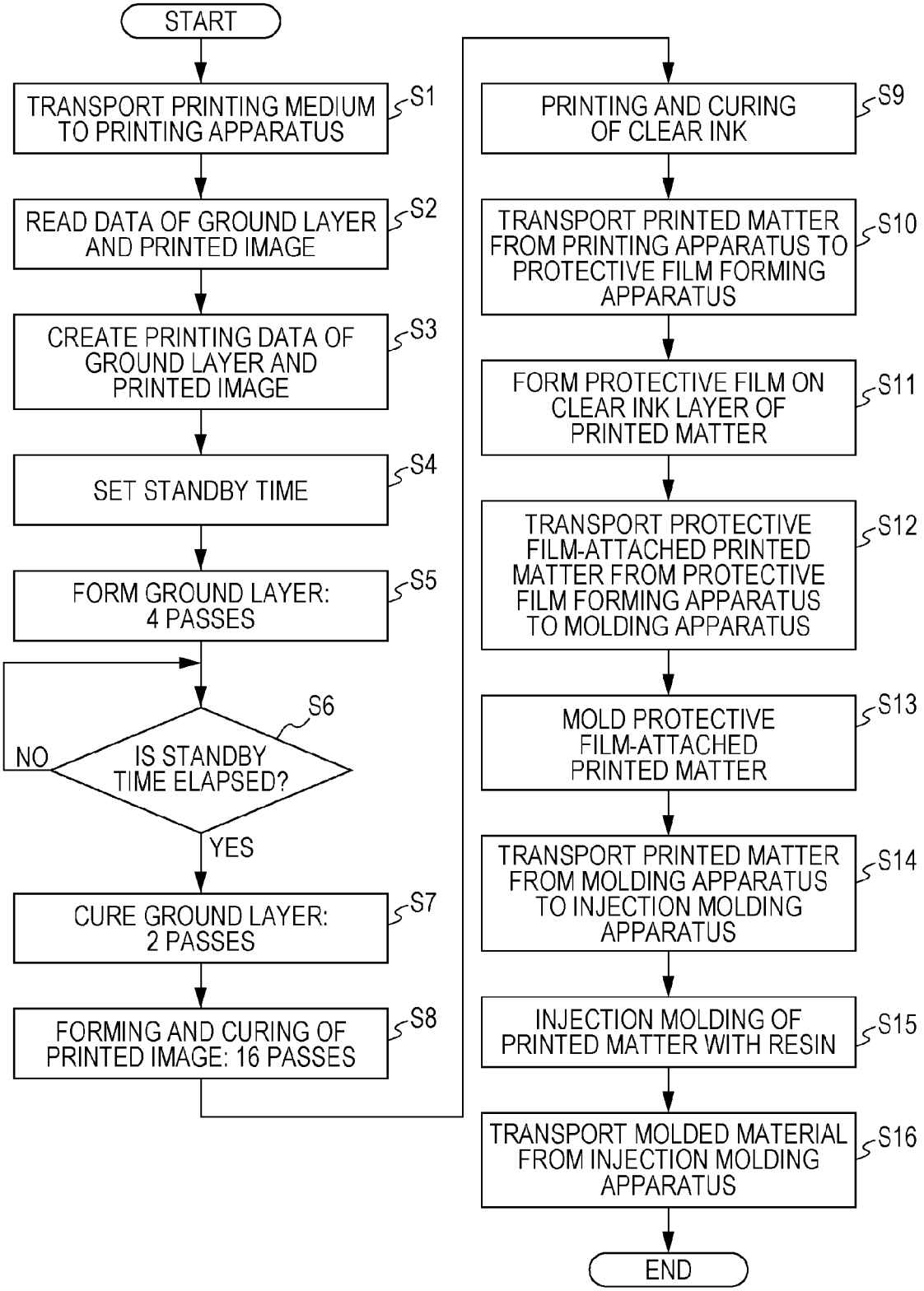
FIG. 4 is a flowchart showing the method of manufacturing a printed matter according to the manufacturing system in FIG. 1.

Next, the manufacturing method of manufacturing the printed matter (molded material) using the manufacturing system 1 shown in FIG. 1 will be described. FIG. 4 is a flowchart showing the method of manufacturing a printed matter according to the manufacturing system in FIG. 1. In the manufacturing system 1, for the apparatuses 1A to 1D, each apparatus 1A to 1D operates according to the control commands from a host computer (not shown) that controls the overall system, and the printing process by the ink jet printing apparatus 1A, a surface working process by the protective film forming apparatus 1B, a molding process by the molding apparatus 1C, and an injection molding process by the injection molding apparatus 1D are realized as described below.

In the manufacturing system 1, when a manufacturing command for manufacturing a printed matter on which an image (equivalent to a ground layer and a printed image) stored on the memory card 7 is stored is provided to the ink jet printing apparatus 1A, the control section 5 of the ink jet printing apparatus 1A performs the printing process while controlling each portion of the apparatus as follows. The printing medium PM before printing is transported into the ink jet printing apparatus 1A by a transport apparatus (not shown), and is mounted on the mounting surface 4*a* of the stage 4 (step S1). The control section 5 reads the printing source data (vector data) of the ground layer and the printed image stored on the memory card 7 either at the same time as or before and after the transport operation of the printing medium PM with the image acquisition section 52 (step S2). Raster data is created by rasterizing the printing source data with the rasterizer section 53. The RGB format raster data is converted to ink amount data by the data processor 54 using a color conversion lookup table (not shown) provided in the EEPROM. In order to execute the printing operation, an interlacing process is performed on printing data taking the order in which the ink dots are formed by the print head 14 into consideration. In this way, printing data for forming the ground layer and the printed image is created (step S3).

The standby time is set based on a variety of information included in the manufacturing command (step S4). The wording "standby time" indicates a time from coating the printing medium PM with the ground layer until the start of irradiating the ground layer with ultraviolet rays, and is determined in the specification as follows. The control section 5 obtains the standby time information in which the standby time is associated with each type of printing medium PM, and the information is stored in the memory (not shown) in a table format. When the standby time derivation section 55 of the control section 5 acquires the medium information pertaining to the type of printing medium PM included in the manufacturing command, the unit reads out the standby time corresponding to the medium information from the table of standby time information, and sets the standby time suitable to the printing medium PM. In the case in which the standby time is included in the manufacturing command, this may be read out, thereby setting the standby time.

Figure 5:
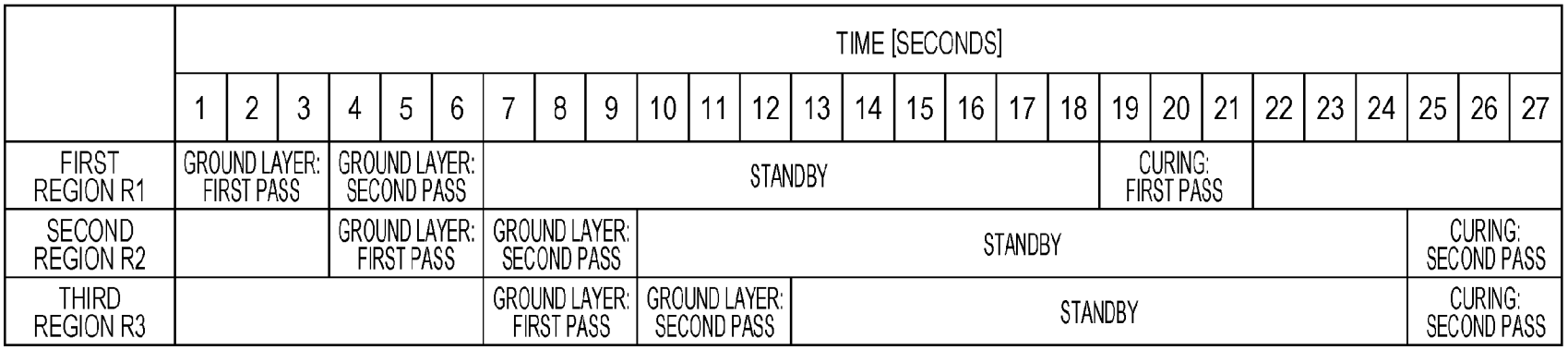
FIG. 5 is a drawing showing an example of a formation schedule of a ground layer.
Figure 6:
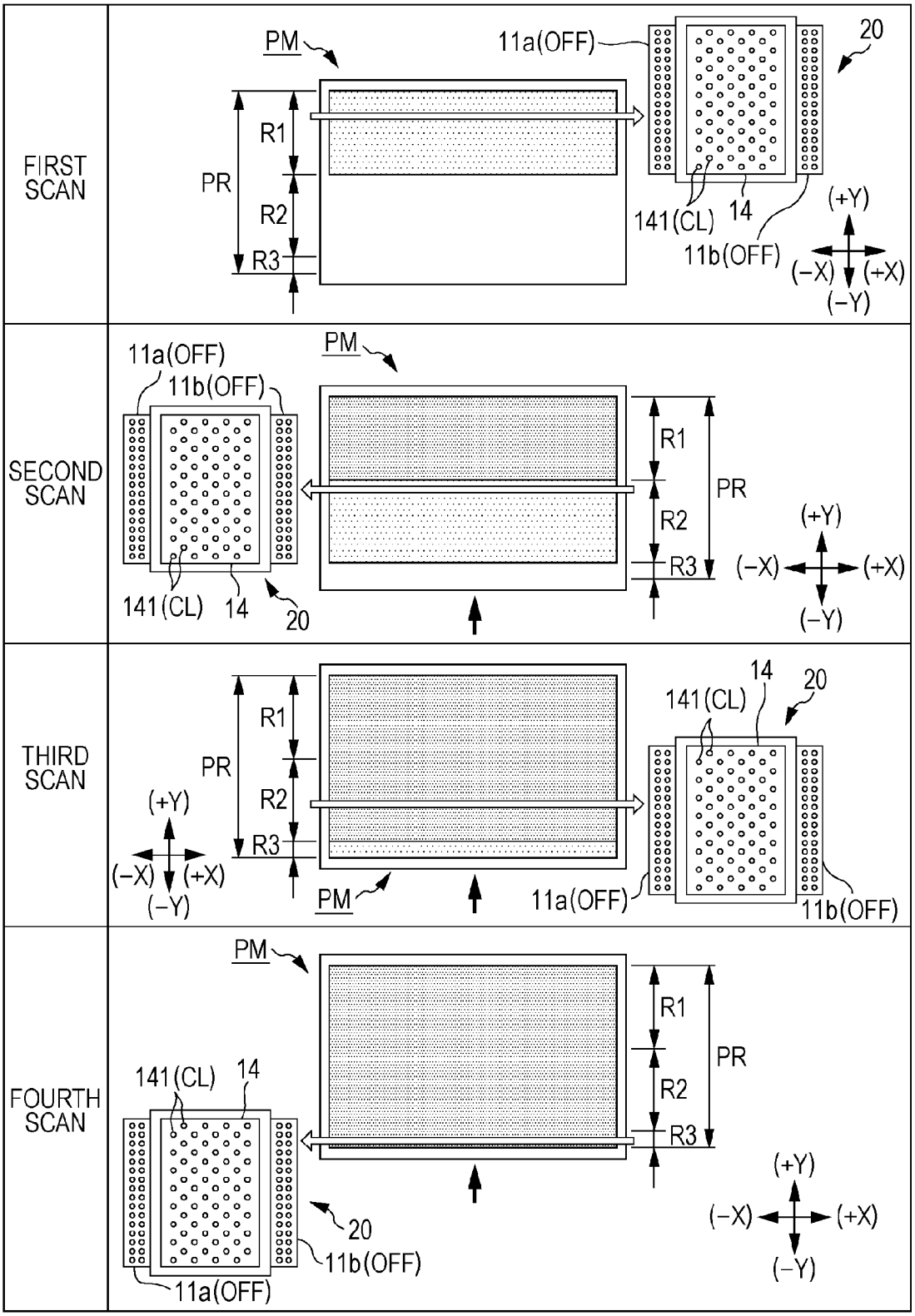
FIG. 6 is a drawing schematically showing a formation operation of a ground layer.
Figure 7:
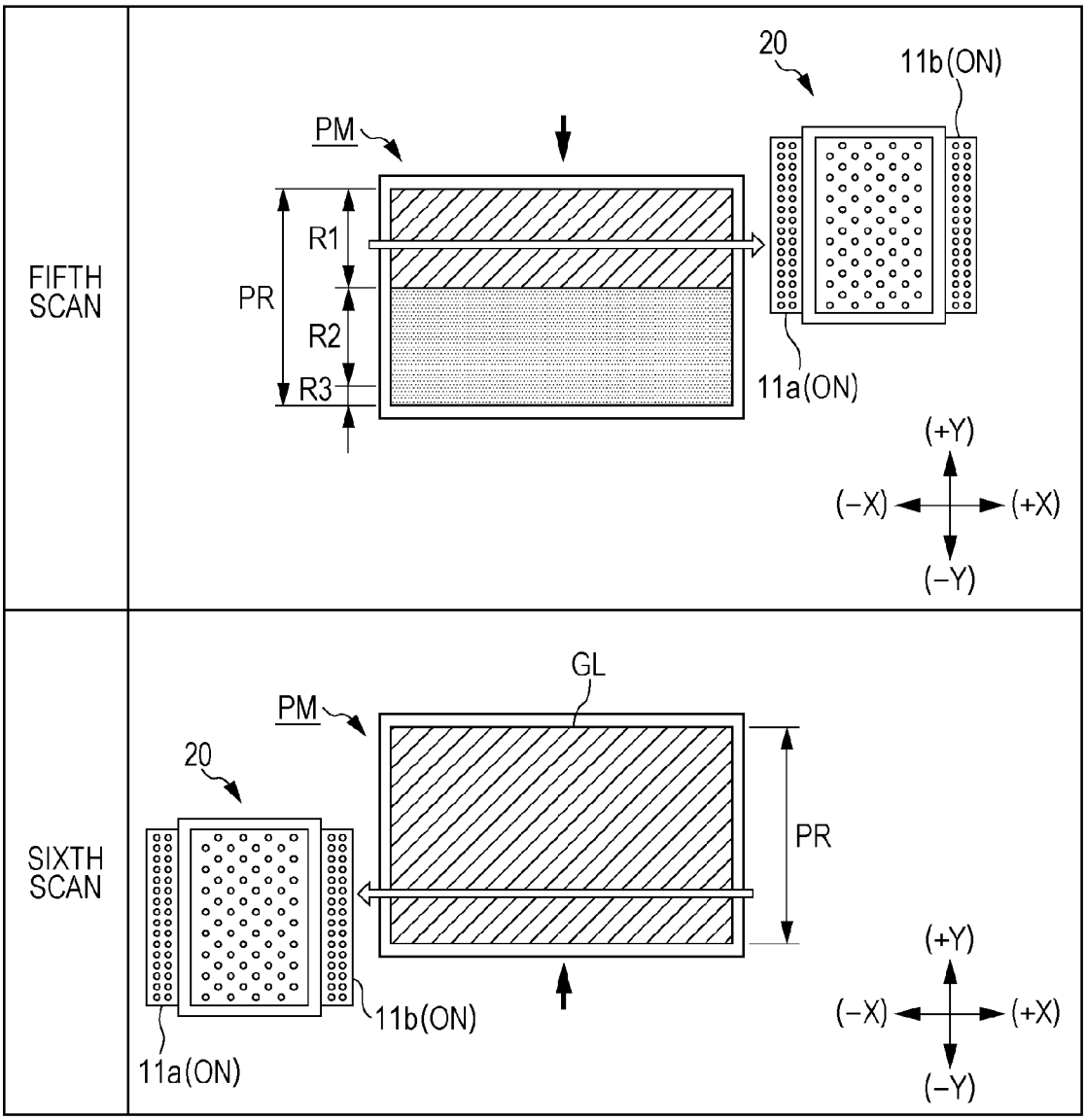
FIG. 7 is a drawing schematically showing a formation operation of a ground layer.

When the printing data of the standby time and the ground layer is prepared, the data processor 54 drives the X-axis motor, the Y-axis motor, the print head 14 and the like based on the printing data of the ground layer, and a total of six scanning operations are executed as shown in FIGS. 5 to 7. Thereby, as described next, the clear ink is applied to the entire printing region PR of the printing medium PM, thereby forming the ground layer. In the embodiment, the printing region in the Y-axis direction (sub-scanning direction) has a width of approximately twice the row length of the row 142.

FIG. 5 is a drawing showing an example of a formation schedule of the ground layer, and the standby time is set to "12 seconds", as shown in FIG. 5. FIGS. 6 and 7 are drawings each schematically showing the formation operation and the curing operation of the ground layer performed according to the formation schedule shown in FIG. 5. In FIGS. 6 and 7 (and FIG. 9 and the like described later), the outlined arrow indicates the X-axis direction movement of the head 20 by the head movement mechanism 21, and the black arrow indicates the Y-axis direction movement of the printing medium PM by the stage movement mechanism 40. In the first embodiment, the printing region PR of the printing medium PM is divided into three regions R1 to R3 in the Y-axis direction, the ground layer GL (FIG. 7) is formed by performing a clear ink application process with four passes (scanning operations) as shown in FIGS. 5 to 6 (step S5 in FIG. 4), a standby process in which the standby is maintained from the application process for a standby time (step S6 in FIG. 4), and a clear ink curing process with two passes (scanning operations) as shown in FIGS. 5 and 7 (step S7 in FIG. 4).

Before the formation operation of the ground layer starts, the head 20 is positioned at the standby position separated from the stage 4 to the (−X) axis direction side, as shown in FIG. 2. By the Y-axis motor being driven by the control section 5, the stage 4 moves in the (−Y) axis direction, and the stage 4 is positioned so that only the first region R1 of the printing medium PM is positioned vertically below the reciprocation path of the head 20. In so doing, the preparation for the execution of the first scanning operation in the formation process of the ground layer is completed. Thus, the clear ink is directly applied to the first region R1 in the form of liquid droplets from the clear nozzle 141 of the print head 14 based on the printing data of the ground layer provided from the control section 5 while the head 20 is moved in the forward direction, that is, in the (+X) axis direction for three seconds. Thereby, the ink dots in the first region R1 are formed at 720 (dpi) in the scanning direction X, and at 360 (dpi) in the transport direction (sub-scanning direction) Y. At this time, either of the two ultraviolet ray radiating sections 11*a* and 11*b* is extinguished, and the irradiation of each ink dot with ultraviolet rays is stopped. Therefore, dissolving of the printing medium PM by the clear ink landed on the first region R1 is started, and the dissolving proceeds until the curing operation, described later, is executed. The stopping of the irradiation of ultraviolet rays is the same in the second to fourth scanning operations in the formation process of the ground layer. The time necessary for one scan of the head 20 in the formation process and the curing process of the ground layer and the standby time as shown in FIG. 5 are the same.

By the Y-axis motor being driven by the control section 5 after the completion of the first scanning operation, the stage 4 moves in the (+Y) axis direction, and the stage 4 is positioned so that the first region R1 and the second region R2 of the printing medium PM are positioned vertically below the reciprocation path of the head 20. In so doing, the preparation for execution of the second scanning operation is completed. Thus, the clear ink is discharged toward the surface of the first and second regions R1 and R2 in the form of liquid droplets from the clear nozzle 141 of the print head 14 based on the printing data of the ground layer provided from the control section 5 while the head 20 is moved in the backward direction, that is, in the (−X) axis direction. Thereby, in the first region R1, ink dots are formed at 720 (dpi)×360 (dpi) shifted in the Y-axis direction by 1/360 (inch) from the ink dots formed by the first scanning operation, and as a result, the ground layer is formed at a resolution of 720 (dpi)×720 (dpi). At the same time, in the second region R2, ink dots are formed with at 720 (dpi)×360 (dpi).

By the Y-axis motor being driven by the control section 5 after completion of the second scanning operation, the stage 4 moves in the (+Y) axis direction, and the stage 4 is positioned so that the second and third regions R2 and R3 of the printing medium PM is positioned vertically below the reciprocation path of the head 20. In so doing, the preparation for execution of the third scanning operation is completed. Thus, the clear ink is discharged toward the second and third regions R2 and R3 in the form of liquid droplets from the clear nozzle 141 of the print head 14 based on the printing data of the ground layer provided from the control section 5 while the head 20 is moved in the forward direction, that is, in the (+X) axis direction. In so doing, the ground layer is formed at a resolution of 720 (dpi)×720 (dpi) in the second region R2 continuous to the first region R1, in the third region R3, ink dots are formed at 720 (dpi)×360 (dpi).

By the Y-axis motor being driven by the control section 5 after completion of the third scanning operation, the stage 4 further moves in the (+Y) axis direction, and the stage 4 is positioned so that only the third region R3 of the printing medium PM is positioned vertically below the reciprocation path of the head 20. In so doing, the preparation for execution of the fourth scanning operation is completed. Thus, the clear ink is discharged toward the third region R3 in the form of liquid droplets from the clear nozzle 141 of the print head 14 based on the printing data of the ground layer provided from the control section 5 while the head 20 is moved in the backward direction, that is, in the (−X) axis direction. Thereby, the ground layer is also formed with a resolution of 720 (dpi)×720 (dpi) in the third region R3 continuous to the first region R1 and the second region R2.

Thus, the ground layer is formed in an uncured state on the entire printing region PR with four scanning operations (4 passes), and the formation of the compatible layer between the clear ink and the printing medium PM proceeds. The head 20 maintains standby at the standby position for the standby time. When the standby time elapses (in step S6, "Yes" is determined), the curing process (step S7) is executed.

In the curing process, by the Y-axis motor being driven by the control section 5 as shown in FIG. 7, the stage 4 moves in the (−Y) axis direction, and the stage 4 is positioned so that only the first region R1 of the printing medium PM is positioned vertically below the reciprocation path of the head 20. In so doing, the preparation for execution of the fifth scanning operation is completed. Thus, the ground layer applied to the first region R1 while moving the head 20 in the forward direction (+X) in a state where the two ultraviolet ray radiating sections 11*a* and 11*b* are lit is cured, and thereby the formation of compatible layer is stopped. At this time, the ink discharging is stopped, and only ultraviolet ray irradiation is executed. This feature is the same as in the next sixth scanning operation.

By the Y-axis motor being driven by the control section 5 after the completion of the fifth scanning operation, the stage 4 moves in the (+Y) axis direction, and the stage 4 is positioned so that the second and third regions R2 and R3 of the printing medium PM are positioned vertically below the reciprocation path of the head 20. In so doing, the preparation for execution of the sixth scanning operation is completed. Thus, the ground layer applied to the second and third regions R2 and R3 while moving the head 20 in the backward direction (−X) in a state where the two ultraviolet ray radiating sections 11*a* and 11*b* are lit is cured, and thereby the formation of compatible layer is stopped. In this way, the ground layer is formed on the entire printing region PR in a state in which the ground layer GL is firmly adhered to the printing region PR.

The description is continued backwarding to FIG. 4. In the next step S8, the data processor 54 drives the X-axis motor, the Y-axis motor, the print head 14, and the like based on the printing data of the ground layer, and prints the printed image on the ground layer GL. Although the method of printing the printed image is not particularly limited, in the embodiment, a total of 16 scanning operations, as shown in FIG. 8, are executed, from the viewpoint of suppressing the gloss irregularities. Thereby, the printing process of forming the printed image in the ground layer GL is executed.

In the embodiment, although the printing image is printed on the ground layer GL by sequentially forming the line images while performing the forward printing and the backward printing on the printing region PR of the printing medium PM while the printing medium PM is intermittently moved in the transport direction Y, the embodiment greatly differs from the apparatus of the related art on the feature of having the next two technical characteristics.

The first technical characteristic is the feature of dividing the printing region PR of the printing medium PM into two areas AR1 and AR2 (refer to FIG. 9) having a width corresponding to the row length of the nozzle row 142 in the transport direction Y, and alternately switching the area in which the line image is formed by the print head 14 of the head 20 between the areas AR1 and AR2. Here, in the embodiment, the nozzle resolution for the printed image of the print head 14, that is, other than clear, is 180 (dpi), and the printed image is printed using the print head 14 with a print resolution is 1440 (dpi) in the main scanning direction (X-axis direction), and 720 (dpi) in the sub-scanning direction (Y-axis direction). Therefore, the forward printing or the backward printing is performed four times, that is four scans are necessary in order to form a 720 (dpi) image in the sub-scanning direction in each of the areas AR1 and AR2.

The second technical characteristic is a feature where, although a desired image is printed with a plurality of line images formed by the head 20 arranged in the transport direction Y, either first area line image formed on the first area AR1 and the second area line image formed on the second area AR2 is formed with two scans. That is, each area line image is formed while layering the line image by the second scan with a comparatively low discharge Duty on a line image formed by the first scan with a comparatively high discharge Duty, rather than being formed with the first scan. Here, the "discharge Duty" is the proportion of the number of ink dots formed on the printing region PR while being discharged in practice from the nozzles 141 with respect to the number of ink dots necessary in order to form the area line image indicated as a percentage. In the embodiment, the ink discharge from the print head 14 is controlled so that the sum of the first discharge Duty and the second discharge Duty is 100(%). That is, the head 20 prints the image according to the printing source data performed with the apparatus disclosed in JP-A-2006-150788, without performing so-called thinning.

Two scans divided into four scans for obtaining such a high resolution image, two scans for forming an area line image divided by discharge Duty (discharge rate), and further divided into two areas AR1 and AR2 are each necessary. Therefore, regarding the image printing of the embodiment, the printing of the image on the printing medium PM is performed with 16 scans (=4×2×2). Thereby, as described next, each first area line image is formed in the first area AR1 with a number of ink dots corresponding to the image on the first area side, and each second area line image is formed in the second area AR2 with a number of ink dots corresponding to the image on the second area side, and thereby the image is printed.

FIG. 8 is a drawing showing an example of a printing process using the ink jet printing apparatus shown in FIG. 2. In the drawing, the wording "area" indicates the area in which the line image is formed by the head 20, and the wording "line image" indicates the line image formed by each scanning operation. Below, the operation of printing the image with the 16 scanning operations will be described with reference to FIGS. 9 to 11.

Figure 9:
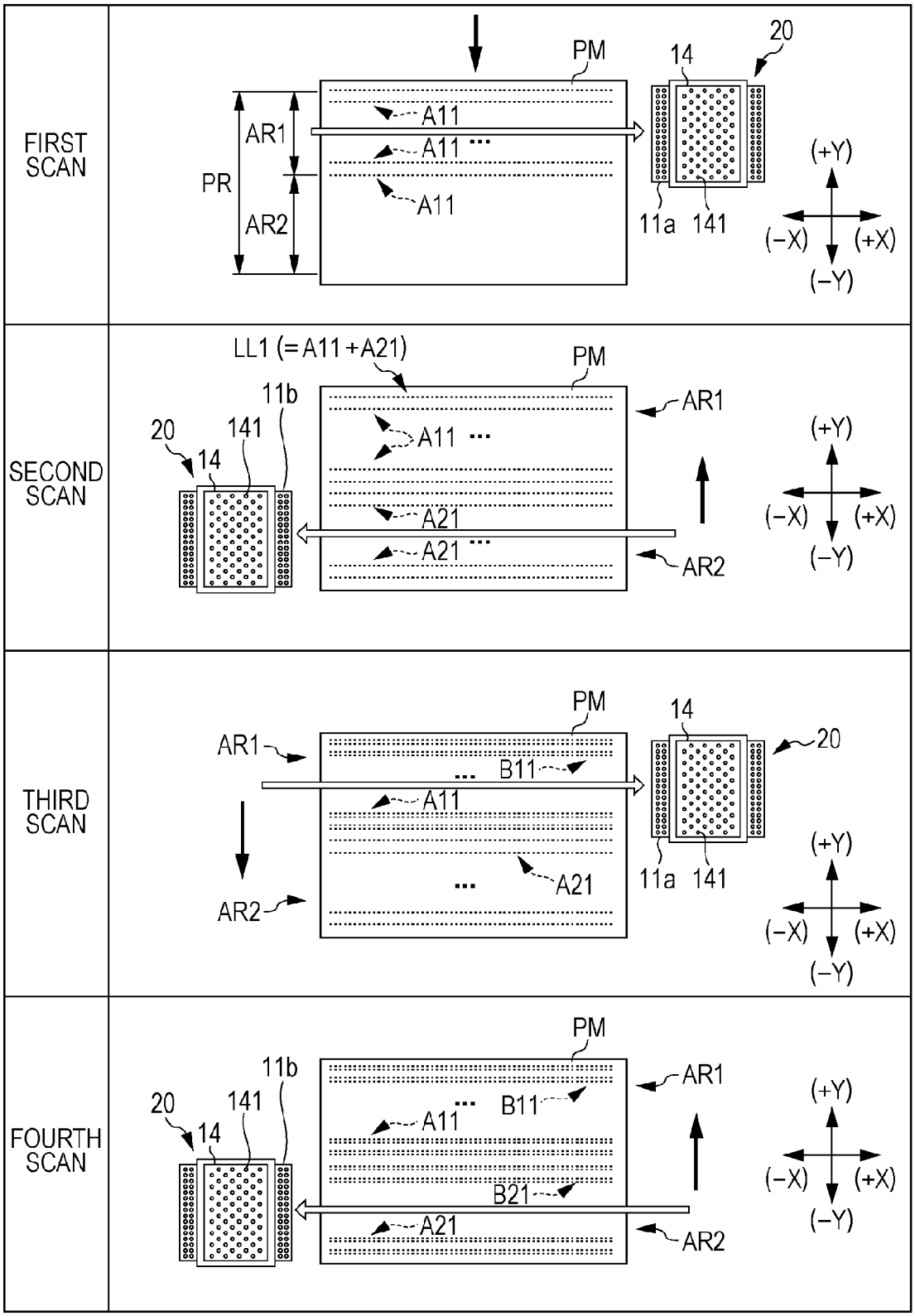
FIG. 9 is a drawing schematically showing a printing operation by the printing apparatus shown in FIG. 2.
Figure 10:
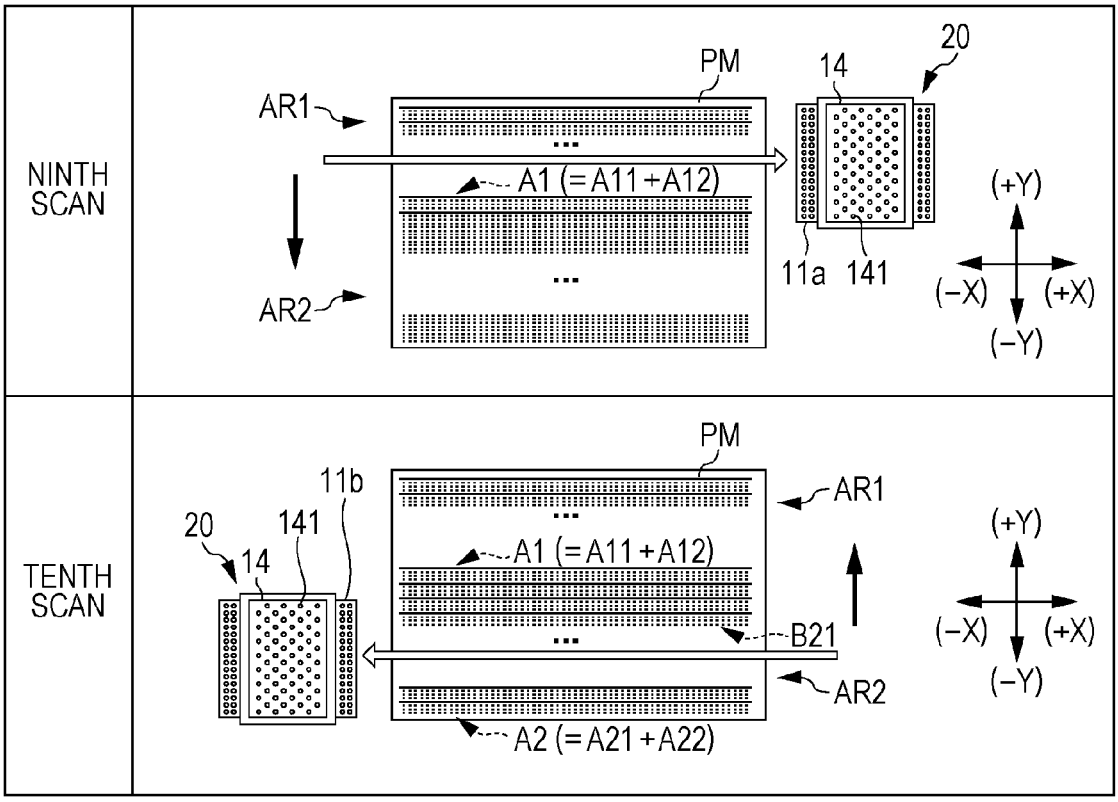
FIG. 10 is a drawing schematically showing a printing operation by the printing apparatus shown in FIG. 2.
Figures 11, 12:
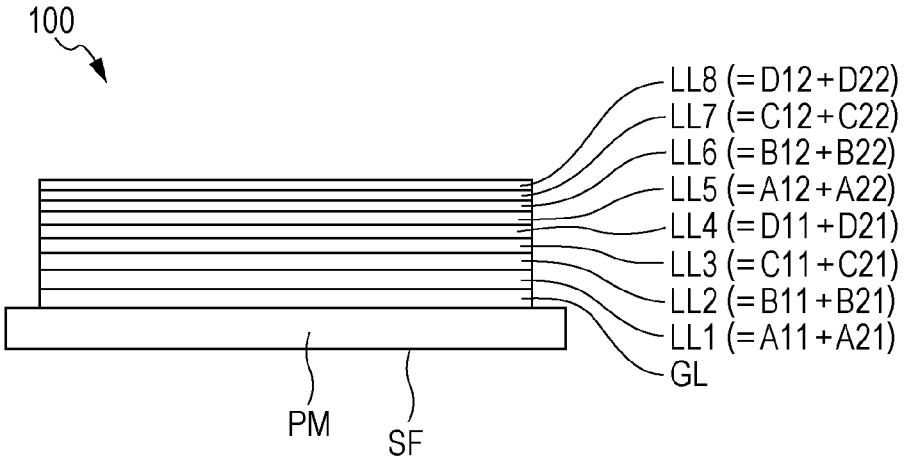
FIG. 11 is a drawing showing an example of a printed matter formed using the printing apparatus shown in FIG. 2.
FIG. 12 is a drawing showing testing results of the influence exerted the compatibilizing time on the adhesiveness of the printed matter.

FIGS. 9 and 10 are drawings schematically showing a printing operation by the ink jet printing apparatus shown in FIG. 2. FIG. 11 is a drawing showing an example of a printing process using the ink jet printing apparatus shown in FIG. 2. Before the formation operation of the printing operation starts, the head 20 is positioned at the standby position separated from the stage 4 to the (−X) axis direction side. By the Y-axis motor being driven by the control section 5 when the printing operation starts, the stage 4 moves in the (−Y) axis direction, and the stage 4 is positioned so that only the first area AR1 of the printing medium PM is positioned vertically below the reciprocation path of the head 20. In so doing, the preparation for execution of the first scanning operation indicated by scanning number "1" in FIG. 8 is completed. Thus, ink is discharged in the form of liquid droplets from the printed image nozzle (nozzle other than the clear nozzle) 141 of the print head 14 toward the ground layer GL of the first area AR1 based on the printing data provided from the control section 5 while the head 20 moves in the forward direction (+X). Thus, as shown in FIG. 9, the ink dots are formed on the ground layer GL of the first area AR1. The ultraviolet ray radiating section 11*a* is lit only while moving in the forward direction in conjunction with the movement in the (+X) axis direction of the head 20, and each dot is irradiated with ultraviolet rays. In so doing, the line image A11 in the X-axis direction is formed as a first layer while curing each ink dot (forward printing). In the first scanning operation, because the "discharge Duty" is set to 60% as shown in FIG. 8, although 40% of the ink dots are not formed at this stage, the line image (reference A12 in FIG. 10) configured by these ink dots is formed layered on the line image A11 by the ninth scanning operation as described later.

At the point in time at which the first scanning operation is completed, the line image is first formed by execution of the second scanning operation indicated by the scanning number "2" in FIG. 8 without any of the line images being formed on the ground layer GL of the second area AR2. That is, by the Y-axis motor being driven by the control section 5, the stage 4 moves in the (+Y) axis direction, and the stage 4 is positioned so that the second area AR2 of the printing medium PM is positioned vertically below the reciprocation path of the head 20. In so doing, the preparation for execution of the second scanning operation is completed. Thus, ink is discharged in the form of liquid droplets from the nozzle 141 of the print head 14 toward the ground layer GL of the second area AR2 based on the printing data provided from the control section 5 while the head 20 moves in the backward direction (−X). The ultraviolet ray radiating section 11*b* is lit only while moving in the backward direction in conjunction with the movement in the (−X) axis direction of the head 20, and each dot is irradiated with ultraviolet rays. In so doing, the line image A21 in the X-axis direction is formed along with a line image A11 already formed on the first area AR1 as a first layer with each ink dot cured, and the first line layer LL1 (FIG. 11) is configured by these line images A11 and A21. Also in the second scanning operation, 40% of the ink dots are not formed at this stage similarly to the first scanning operation, the line image (reference A22 in FIG. 10) configured by these ink dots is formed layered on the line image A21 by the tenth scanning operation as described later.

When the second scanning operation is completed, by the Y-axis motor being driven in the reverse direction by the control section 5, the stage 4 moves in the (−Y) axis direction as shown in FIG. 9, and the stage 4 is positioned so that the first area AR1 of the printing medium PM is positioned vertically below the reciprocation path of the head 20 and shifted by one dot further in the (+Y) axis direction than during the first scanning operation. In this way, the preparation for execution of the third scanning operation indicated by scanning number "3" in FIG. 8 is completed. Thus, ink is discharged from the printed image nozzle 141 of the print head 14 toward the surface of the first area AR1 based on the printing data of the printed image provided from the control section 5 while the head 20 moves in the forward direction (+X). In this way, the ink dots are formed so as to partially overlap the line image A11 in the ground layer GL of the first area AR1. The ultraviolet ray radiating section 11*a* is lit only while moving in the forward direction in conjunction with the movement in the (+X) axis direction of the head 20, and each dot is irradiated with ultraviolet rays. In so doing, the line image B11 in the X-axis direction is formed as a second layer while curing each ink dot (forward printing). In the third scanning operation, because the "discharge Duty" is set to 70% as shown in FIG. 8, although 30% of the ink dots are not formed at this stage, the line image B11 configured by these ink dots is formed layered on the line image B11 by the eleventh scanning operation.

By the Y-axis motor being driven by the control section 5 after the third scanning operation, the stage 4 moves in the (+Y) axis direction, and the stage 4 is positioned so that the second area AR2 of the printing medium PM is positioned vertically below the reciprocation path of the head 20 and shifted by one dot further in the (+Y) axis direction than in the second scanning operation as shown in FIG. 9. In so doing, the preparation for execution of the fourth scanning operation indicated by scanning number "4" in FIG. 8 is completed. Thus, ink is discharged from the printed image nozzle 141 of the print head 14 toward the surface of the second area AR2 based on the printing data of the printed image provided from the control section 5 while the head 20 moves in the backward direction (−X). In this way, the ink dots are formed so as to partially overlap the line image A21 in the second area AR2. The ultraviolet ray radiating section 11*b* is lit only while moving in the backward direction in conjunction with the movement in the (+X) axis direction of the head 20, and each dot is irradiated with ultraviolet rays. In so doing, the line image B21 in the X-axis direction is formed along with a line image B11 already formed on the first area AR1 as a second layer while curing each ink dot (backward printing). The second line layer LL2 (FIG. 11) is configured layered on the first line layer LL1 with the line images B11 and B21. In the fourth scanning operation, similarly to the third scanning operation, 30% of the ink dots are not formed at this stage, and the line image configured by these ink dots is formed layered on the line image B21 by the twelfth scanning operation.

By the transport of such a printing medium PM and the scanning operations indicated by the scan numbers "5" to "8" in FIG. 8 being repeated, the third line images C11 and C21 with a "discharge Duty" of 80% and the fourth line images D11 and D21 with a "discharge Duty" of 90% are formed. In the embodiment, after printing while forming the line image on the entire printing region PR at a comparatively high "discharge Duty", that is 60% or more, the scanning operations indicated by the scan numbers "9" to "16" in FIG. 8 corresponding to the reciprocating transport of the printing medium PM in the transport direction Y, that is, from the ninth to the sixteenth scanning operations are further executed.

By the Y-axis motor being driven by the control section 5, the stage 4 moves in the (−Y) axis direction as shown in FIG. 10, and the stage 4 is positioned so that the first area AR1 of the printing medium PM is positioned vertically below the reciprocation path of the head 20, and is at the same position in the Y-axis direction as during the first scanning operation. Subsequently, ink is discharged from the printed image nozzle 141 of the print head 14 toward the surface of the first area AR1 based on the printing data of the printed image provided from the control section 5 while the head 20 moves in the forward direction (+X). In this way, the ink dots are formed on the line image A11 in the first area AR1. The ultraviolet ray radiating section 11*a* is lit only while moving in the forward direction in conjunction with the movement in the (+X) axis direction of the head 20, and each dot is irradiated with ultraviolet rays. In so doing, the line image A12 in the X-axis direction is formed as a fifth layer while curing each ink dot (forward printing). Here, 40% of the ink dots not formed with the first scanning operation as described above are formed, and the first area line image A1 on which the line images A11 and A12 are stacked is formed.

After the ninth scanning operation, by the Y-axis motor being driven by the control section 5, the stage 4 moves in the (+Y) axis direction as shown in FIG. 10, and the stage 4 is positioned so that the second area AR2 of the printing medium PM is positioned vertically below the reciprocation path of the head 20 and at the same position as during the second scanning. Subsequently, ink is discharged from the black nozzle 141 of the print head 14 toward the surface of the second area AR2 based on the printing data provided from the control section 5 while the head 20 moves in the backward direction, that is, in the (−X) direction. The ink dots are formed on the line image A21 in the second area AR2 by the tenth scanning operation. The ultraviolet ray radiating section 11*b* is lit only while moving in the backward direction in conjunction with the movement in the (+X) axis direction of the head 20, and each dot is irradiated with ultraviolet rays. In so doing, the line image A22 in the X-axis direction is formed along with the line image A21 already formed on the first area AR1 as a fifth layer while curing each ink dot (backward printing). Here, 40% of the ink dots not formed with the second scanning operation as described above are formed, and the second area line image A2 on which the line images A21 and A22 are stacked is formed.

By the transport of the printing medium PM and the remaining eleventh to sixteenth scanning operations being repeated, the sixth to eighth line layers LL6 to LL8 are formed and the first area line image and the second area line image are formed three at a time. That is, the line images B12 and B22 that configure the sixth line layer LL6 are formed layered on the line images B11 and B21, respectively, with a "discharge Duty" of 30%, and the first area line image (=B11+B12) and the second area line image (=B21+B22) are obtained. The line images C12 and C22 that configure the seventh line layer LL7 are formed layered on the line images C11 and C21, respectively, with a "discharge Duty" of 20%, and the first area line image (=C11+C12) and the second area line image (=C21+C22) are obtained. The line images D12 and D22 that configure the eighth line layer LL8 are formed layered on the line images D11 and D21, respectively, with a "discharge Duty" of 10%, and the first area line image (=D11+D12) and the second area line image (=D21+D22) are obtained.

The printing region PR of the printing medium PM is divided into two areas AR1 and AR2 having a width corresponding to the row length of the nozzle row 142 in the Y direction. The line images A11, A21 . . . D12, and D22 are formed in the order while alternately switching the area forming the line image with the print head 14 of the head 20 between the areas AR1 and AR2. Therefore, the actions and effects below are obtained. When all line images are formed on the area AR1 and then all line images are formed on the area AR2 similarly to the apparatus of the related art, the gloss irregularities between the areas AR1 and AR2 become large. Also within each area, gloss irregularities occur caused by the difference in curing timing. A lowering of image quality occurs in light of these causes. In contrast, in the embodiment, because the line images are alternately formed between areas, it is possible to greatly suppress the gloss irregularities between areas. All regions of the printing region PR are formed in the same raster order, and it is possible for the gloss irregularities caused by differences in the curing timings of the inks to be dispersed to all regions of the printing region PR, and it is possible to reduce the gloss irregularities. As a result, it is possible to print a high quality image.

The description will continue returning to FIG. 4. When the printed matter 100 having a layered structure in which a plurality of ink layers is layered by layering the ground layer GL and the line layers LL1 to LL8 on the printing medium PM, as shown in FIG. 11, a clear ink is applied, and a clear ink layer is cured, thereby forming a clear protective film that protects the printed image, similarly to the formation process and the curing process of the ground layer (step S9).

When printing on the printing medium PM by the ink jet printing apparatus 1A is completed as above, the printed matter is transported from the printing apparatus 1A to the protective film forming apparatus 1B by the transport apparatus, not shown (step S10). A protective film is formed on the uppermost layer of the printed matter, that is, on the cured clear ink layer by the protective film forming apparatus 1B (step S11). That is, a protective film is formed by a coating work, lamination work or the like performed in the protective film forming apparatus 1B.

The printed matter on which the protective layer is formed by the protective film forming apparatus 1B, that is, a protective film-attached printed matter is transported from the protective film forming apparatus 1B to the molding apparatus 1C by the transport apparatus (not shown) (step S12). The protective layer-attached printed matter is subjected to a vacuum molding or pneumatic molding by the molding apparatus 1C, thereby working the protective layer-attached printed matter into a desired shape, for example, into the half cut shape of a beverage commodity container or the shape of a vehicle instrument panel (step S13).

The printed mater subjected to molding by the molding apparatus 1C is transported from the molding apparatus 1C to the injection molding apparatus 1D by the transport apparatus (not shown) (step S14). A resin material is injected and formed on the opposite side to the printed surface from both main surfaces of the printed matter, that is on the surface on which the ground layer GL and the line layer LL1 and LL8 are not printed (reference SF in FIG. 11) (step S15). The material used in the injection molding is arbitrary, and it is possible for a copolymer synthetic resin of acrylonitrile, butadiene, and styrene to be used. It is preferable for injection molding to be performed using the same resin material as the printing medium PM, when the printing medium PM is configured by a resin material. In particular, both the constituent material and the injection molding material of the printing medium PM being a copolymer synthetic resin of acrylonitrile, butadiene and styrene is suitable.

Finally, the printed matter subjected to injection molding work by the injection molding apparatus 1D (molded matter) is transported from the injection molding apparatus 1D by the transport apparatus (not shown) (step S16).

As above, according to the embodiment, both of the two ultraviolet ray radiating sections 11*a* and 11*b* are extinguished while the printing medium PM is coated with the clear ink in order to form the ground layer GL. The head 20 is moved in the main scanning direction X while the ultraviolet ray radiating sections 11*a* and 11*b* are lit after the standby time (in the embodiment, 12 seconds as shown in FIG. 5) elapses, thereby curing the ground layer GL. By providing a standby time in this way, the surface of the printing medium PM is dissolved by the clear ink during the standby time, thereby forming the compatible layer, and thereafter, the ground layer GL is cured. By controlling the irradiation and the stopping of irradiation of the ground layer with the ultraviolet rays, it is possible for a compatible layer to be sufficiently formed in order for the ground layer GL and the printing medium PM to be adhered. Accordingly, it is possible for the adhesive force of the ink to the printing medium PM to be increased, and for the image to be stably supported on the printing medium PM. As a result, even if the printed matter is formed from a flat sheet shape into a complicated shape by molding, it is possible to prevent a problem of the printed image becoming damaged or the like while the printed image follows deformation of the printing medium PM from arising.

In the embodiment as described above, although the standby time is set to "12 seconds", this takes changes of the adhesive force of clear ink to the printing medium PM according to the standby time, that is the compatibilizing time for the clear ink and the printing medium PM to melt into one another into consideration. Cross cut testing compliant with JISK 5400 is performed as testing in which the adhesiveness of the printed matter on which the ground layer and the printed image are formed on the printing medium PM while the compatibilizing time is changed from 0.5 "seconds" to 65 "seconds". A summary of the testing results is shown in FIG. 12.

FIG. 12 is a drawing showing testing results of the influence the compatibilizing time exerts on the adhesiveness of the printed matter. The "adhesiveness" in the drawing indicates the proportion of the cut piece remaining on the printing medium PM after stripping of the tape, when all of the cut pieces in which the layered body (=ground layer and the printed image) formed on the printing medium PM is cut in a grid shape is 100. That is, the adhesiveness increases as the proportion approaches 100/100. The wording the "compatibilizing time is "0.5" signifies a case of performing the curing process similarly to the apparatus of the related and the wording the "compatibilizing time is "1.0" signifies a case of setting the scanning speed to be comparatively slow in the apparatus of the related art. Otherwise, a case of setting the standby time as in the embodiment is signified.

As is clear from the drawing, favorable adhesiveness is obtained by providing a compatibilizing time of 3 seconds or more while providing the standby time. This signifies that a time of 3 seconds or more is necessary for the printing medium PM and the clear ink to melt into one another, and the adhesiveness improves as the compatibilizing time becomes longer, thereby obtaining superior adhesiveness. However, when a fixed time elapses, lowering of the adhesiveness begins, and when 45 seconds elapses, the lowering becomes sharp. This is considered to be caused by the compatible layer spreading according to lengthening of the standby time, and the compatible layer not easily solidifying. In order to obtain favorable adhesiveness when based on such testing results, it is necessary to provide a standby time of three or more seconds with the ultraviolet ray radiating sections 11*a* and 11*b* extinguished while at least the print head 14 is scanned. In order for the compatible layer to be cured by the ultraviolet ray irradiation, it is preferable for the standby time to be set so as to not exceed 45 seconds. In order to further obtain superior adhesiveness, it is preferable for the standby time to be set to 6.0 seconds to 20 seconds.

The relationship between the compatibilizing time and the adhesiveness fluctuates according to the printing conditions, and, in particular, the type of printing medium PM or the type of main monomer of the ink. In the embodiment, the standby time information is stored in advance, and the optimal value of the standby time is derived from the medium information pertaining to the type of printing medium PM. Accordingly, it is possible for a standby time suitable to the various printing media PM to be set, and it is possible to form the ground layer GL with a high adhesive force even for any type of printing medium PM. As a result, superior versatility is obtained. Naturally, a configuration may be used so that the curing timing of the ground layer GL is controlled while deriving the optimal value of the standby time in further consideration of not only the type of printing medium PM, but also the type of ink.

In the embodiment, the lighting and extinguishing of the ultraviolet ray radiating sections 11*a* and 11*b* according to the commands from the radiation controller 51 is controlled. Therefore, when the ground layer GL is cured, or when the line layers LL1 to LL8 that configure the printed image are cured, the radiation of ultraviolet rays from the ultraviolet ray radiating sections 11*a* and 11*b* is the same. The ground layer GL is coated with the clear ink, and further cured while irradiated with ultraviolet rays after the standby time elapses. Therefore, leveling proceeds better than when forming the line layers LL1 to LL8. Therefore, when the leveled ground layer GL is irradiated with strong ultraviolet rays, an ink film is formed, and wrinkles due to curing shrinkage potentially arise, leading to surface degradation of the ground layer GL. Accordingly, it is desirable to set the illuminance of the ultraviolet rays as in the embodiment to be the same as the illuminance at which surface degradation does not arise. In consideration of these features, the illuminance of the ultraviolet rays when the ground layer GL is cured may be set to a lower value than when the line layers LL1 to LL8 are cured.

In the embodiment as described above, the ground layer GL and the line layer LL1 to LL8 correspond to an example of the "ink layer" in the invention, and the printed matter 100 including a layered structure as shown in FIG. 11 corresponds to an example of the "layered body" in the invention. In the printed matter 100, the ground layer GL corresponds to the "lowermost layer" in the invention, and the line layers LL1 to LL8 correspond to the "image layer" in the invention. The clear ink corresponds to the example of the "first photocurable ink" in the invention. The head 20 functions as the "first ink layer forming section" and the "second ink layer forming section" in the invention. The ultraviolet ray radiating sections 11*a* and 11*b* correspond to an example of the "light radiating section" in the invention. The head movement mechanism 21 corresponds to an example of the "movement section" in the invention.

The invention is not limited to the above embodiments, and various modifications other than those described above are possible as long as not departing from the gist thereof. For example, although the ground layer GL is formed with the clear ink in the first embodiment, a white ink may be used instead of the clear ink.

In the first embodiment, although the printing region PR is divided into three regions R1 to R3 in forming the ground layer GL, the number of divisions is not limited thereto, and it is possible to set an appropriate number of divisions in consideration of the length of the nozzle row and the length in the Y-axis direction of the printing region PR.

In the first embodiment, although the ground layer GL is formed with a resolution of 720 (dpi)×720 (dpi), the resolution is not limited thereto, and is arbitrary. Because the adhesiveness is mainly improved while forming a compatible layer between the printed image and the printing medium PM with the ground layer GL, it is possible to achieve a shortening of the printing time by being configured so as to form the ground layer GL with a lower number of passes (number of scanning operations).

In the first embodiment, although the predetermined image is formed while layering the line layers LL1 to LL8 on the ground layer GL, the line layers LL1 and LL8 may be formed on the printing medium PM without providing the ground layer. In this case, the line layer LL1 is the lowermost layer. The same actions and effects as the embodiment are obtained by configuring the line layer LL1 so as to form the line layer L11 is formed while applying the ink other than the clear ink, and irradiating and curing at least the line layer L11 with ultraviolet rays after three or more seconds elapse (second embodiment). Below the second embodiment of the invention will be described with reference to FIGS. 13 and 14.

Figure 13:
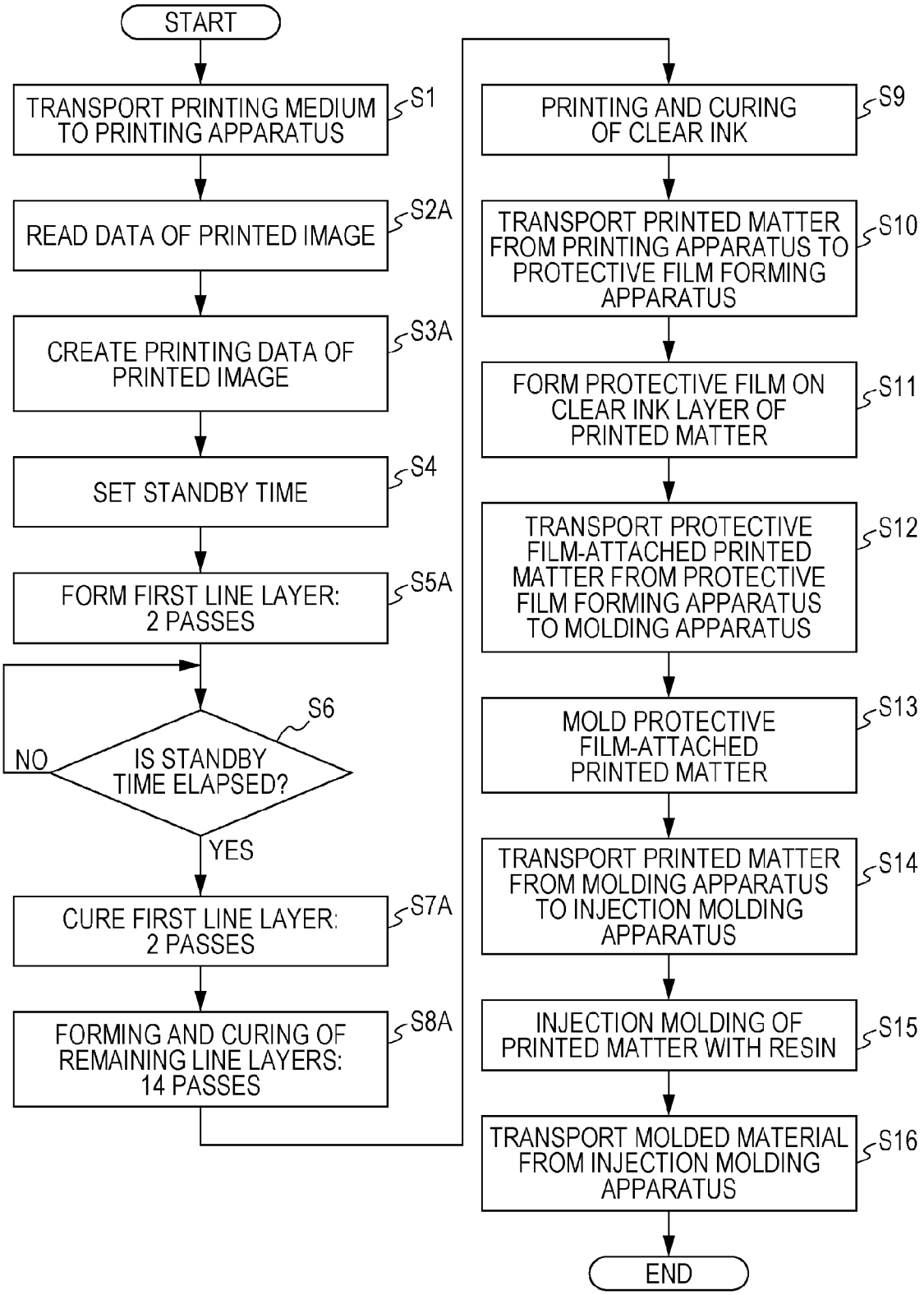
FIG. 13 is a flowchart showing the method of manufacturing a printed matter in a second embodiment of the invention.
Figure 14:
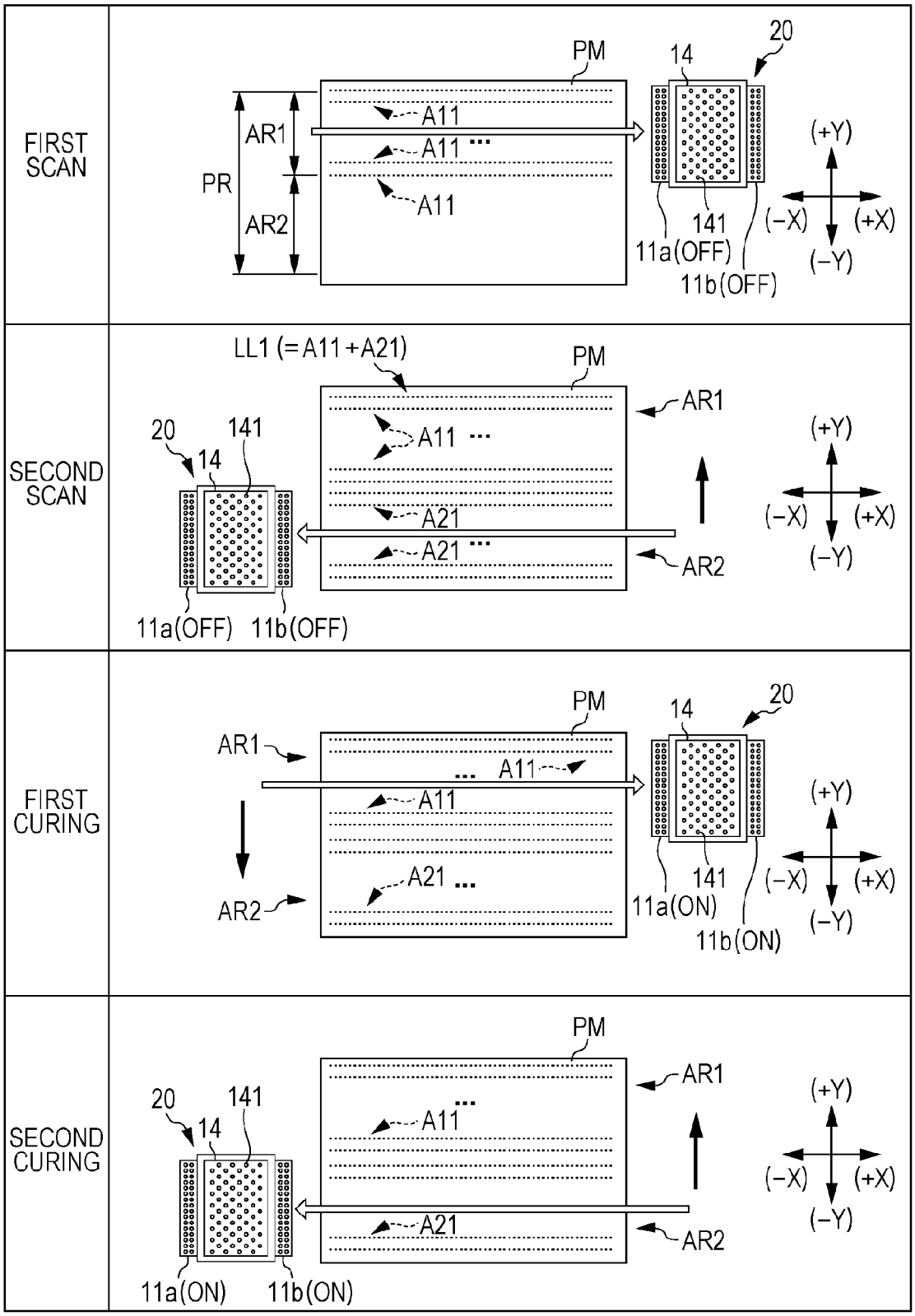
FIG. 14 is a drawing schematically showing a formation process and a curing process of the lowermost layer in the second embodiment.

FIG. 13 is a flowchart showing the method of manufacturing a printed matter in a second embodiment of the invention. FIG. 14 is a drawing schematically showing a formation process and a curing process of the lowermost layer in the second embodiment. The configuration of the printing system to which the second embodiment is applicable is the same as the first embodiment, and is the same as the first embodiment other than the features of not providing the ground layer, and the formation process and the curing process of the line layer LL1 being different. The second embodiment will be described centering on the differing features, and description of the same configuration and same operations will not be made.

In the second embodiment, when a manufacturing command for manufacturing a printed matter on which an image (equivalent to a printed image) stored on the memory card 7 is stored is provided to the ink jet printing apparatus 1A, the control section 5 of the ink jet printing apparatus 1A performs the printing process while controlling each portion of the apparatus 1A as follows. The printing medium PM before printing is transported into the ink jet printing apparatus 1A by a transport apparatus (not shown), and is mounted on the mounting surface 4*a* of the stage 4 (step S1). The control section 5 reads the printing source data (vector data) of the printed image stored on the memory card 7 either at the same time as or before and after the transport operation of the printing medium PM with the image acquisition section 52 (step S2A). The printing data for forming the printed image is created similarly to the first embodiment (step S3A).

After the standby time is set based on various items of information included in the manufacturing command (step S4), the line image of the first layer is formed (step S5A).

Before the formation operation of the first line layer starts, the head 20 is positioned at the standby position separated from the stage 4 to the (−X) axis direction side. Firstly, by the Y-axis motor being driven by the control section 5 during the starting of the formation operation, the stage 4 moves in the (−Y) axis direction, and the stage 4 is positioned so that the first area AR1 of the printing medium PM is positioned vertically below the reciprocation path of the head 20. In so doing, the preparation for the execution of the first scanning operation of the 16 scanning operations for forming the printed image is completed. Thus, ink is discharged in the form of liquid droplets from the printed image nozzle (nozzle other than the clear nozzle) 141 of the print head 14 toward the surface of the first area AR1 based on the printing data provided from the control section 5 while the head 20 moves in the forward direction (+X). Thus, as shown in FIG. 14, the line image A11 is directly formed on the first area AR1. In the second embodiment, both of the ultraviolet ray radiating sections 11*a* and 11*b* are extinguished even while the head 20 for forming the line image A11 is moved in the (+X) axis direction. This feature is the same as in the following second scanning operation.

When the first scanning operation is completed, by the Y-axis motor being driven by the control section 5, the stage 4 moves in the (+Y) axis direction, and the stage 4 is positioned so that the second area AR2 of the printing medium PM is positioned vertically below the reciprocation path of the head 20. In so doing, the preparation for execution of the second scanning operation is completed. Thus, ink is discharged in the form of liquid droplets from the nozzle 141 of the print head 14 toward the surface of the second area AR2 based on the printing data provided from the control section 5 while the head 20 moves in the backward direction (−X). In so doing, the line image A21 in the X-axis direction is formed along with a line image A11 already formed on the first area AR1 as a first layer, and the first line layer LL1 is configured by these line images A11 and A21.

When the formation of the line layer LL1 is completed in this way, in a state where the apparatus waits until the standby time passes (determination of "Yes" in step S6), the ink discharge from the print head 14 is stopped while the ultraviolet ray radiating sections 11*a* and 11*b* are lit, the head 20 and the stage 4 are operated similarly to the formation of the line layer LL1. That is, by the Y-axis motor being driven by the control section 5, the stage 4 moves in the (−Y) axis direction, and the stage 4 is positioned so that the first area AR1 of the printing medium PM is positioned vertically below the reciprocation path of the head 20. Subsequently, the head 20 moves in the forward direction (+X). During the movement, the ultraviolet ray radiating sections 11*a* and 11*b* are lit, and the line image A11 is cured (first curing). When the first curing is completed, by the Y-axis motor being driven by the control section 5, the stage 4 moves in the (+Y) axis direction, and the stage 4 is positioned so that the second area AR2 of the printing medium PM is positioned vertically below the reciprocation path of the head 20. Subsequently, the head 20 moves in the backward direction (−X), and during the movement, the ultraviolet ray radiating section 11*a* and 11*b* are lit, and the line image A21 is cured (second curing). In this way, the curing process of the first line layer LL1 is completed.

Subsequently thereto, similarly to the first embodiment, the printed image is formed while forming the remaining line layers LL2 to LL8 layered on the line layer LL1 (step S8A), and the steps S9 to S16 are further executed.

As above, although in the second embodiment the first line layer LL1 corresponds to the "lowermost layer" in the invention, and the line layer LL1 is subjected to the curing process after the standby time elapses, similarly to the ground layer GL in the first embodiment. Therefore, the compatible layer is sufficiently formed during the standby time and the printing medium PM and the line layer LL1 thereby have superior adhesiveness. The desired image is printed while the remaining line layers LL2 to LL8 are layered on the line layer LL1. Accordingly, the same actions and effects as the first embodiment are obtained.

In the second embodiment, although the line layer LL1 is the "lowermost layer" in the invention, the layer initially formed by the plurality of line images A11 may be used as the "lowermost layer" in the invention. Conversely, a layer including not only the line images A11 and A21, but also line images B11, B21, . . . and the like formed subsequently thereto may be used as the "lowermost layer" in the invention. That is, the line layer configured by the line image formed by several scans from the beginning may be used as the "lowermost layer" in the invention.

In the first and second embodiments, although both of the ultraviolet ray radiating sections 11*a* and 11*b* are lit when the lowermost layer is cured, a configuration may be used so that only either one is lit.

In the first and second embodiments, although the protective film forming apparatus 1B, molding apparatus 1C, and injection molding apparatus 1D are used as the post-processing apparatus of the printed matter printed by the ink jet printing apparatus 1A, the post-processing content is not limited thereto, and a shearing apparatus, a boring apparatus, or a blanking apparatus may be used as the post-processing apparatus. In this case, it is possible for ink cracking and the like to be prevented during searing, boring or blanking by using the printing apparatus 1A configured as described above, thereby obtaining superior workability. Naturally, it goes without saying that the ink jet printing apparatus 1A may be used independently.

This application claims priority to Japanese Patent Application No. 2014-260348 filed on Dec. 24, 2014. The entire disclosure of Japanese Patent Application No. 2014-260348 is hereby incorporated herein by reference.

What is claimed is:

1. A printing apparatus that prints an image while forming a layered body, which has a layered structure in which a plurality of ink layers formed by applying a photocurable ink is layered and at least a portion of the plurality of ink layers is an image layer, on a printing medium, the printing apparatus comprising:

a head configured to coat the printing medium with a first photocurable ink that configures a lowermost layer of the plurality of ink layers to form the lowermost layer apply an ink layer other than the lowermost layer after the first photocurable ink is cured, and form the image layer, the image layer being formed with a plurality of scanning operations; and a controller communicating with the head and configured to control irradiation of the lowermost layer with light to cure the first photocurable ink, the lowermost layer being formed with N (N>=2) scanning operations, the controller being configured to not irradiate the lowermost layer with light during scanning operations 1 to N, and after N scanning operations, the lowermost layer being irradiated with light after at least three seconds have elapsed from an end of the head coating the printing medium, and the controller being configured to irradiate the image layer with light during each scanning operation of the plurality of scanning operations.

2. The printing apparatus according to claim 1, wherein the controller controls curing of lowermost layer until after 45 seconds have elapsed from a time of applying the first photocurable ink.

3. The printing apparatus according to claim 1, wherein the controller controls curing of the ink layer while irradiating another ink layer other than the lowermost layer with light.

4. The printing apparatus according to claim 1, further comprising:

a standby time derivation section that derives a standby time corresponding to the type of printing medium based on standby time information in which standby is maintained from formation of the lowermost layer to the start of irradiation of the lowermost layer with light is associated with each type of the printing medium, wherein irradiation of the lowermost layer with light starts after standby for the standby time derived by the standby time derivation section.

5. The printing apparatus according to claim 1, wherein the layered body is formed with the image layer layered on a ground layer, and the lowermost layer is the ground layer.

6. The printing apparatus according to claim 1, wherein the layered body is formed by layering a plurality of image layers, and the lowermost layer is the lowermost layer of the plurality of image layers.

7. The printing apparatus according to claim 1, wherein the ink is a liquid that is cured when irradiated with ultraviolet rays.

8. A printing apparatus that prints an image while forming a layered body, which has a layered structure in which a plurality of ink layers formed by applying a photocurable ink is layered on a printing medium, and at least a portion of the plurality of ink layers is an image layer, the printing apparatus comprising:

a print head that applies the photocurable ink on the printing medium to form an image layer of the plurality of ink layers, the image layer being formed with a plurality of scanning operations;

a light radiating section that causes the photocurable ink to be cured while irradiating the photocurable ink applied by the print head with light;

a carriage that holds the print head and the light radiating section;

a movement section that moves the carriage in a main scanning direction; and a radiation controller that controls radiation and stopping of radiation of light by the light radiating section, wherein the radiation controller stops the radiation of light from the light radiating section while the first photocurable ink that configures the lowermost layer of the plurality of ink layers is applied on the printing medium by the print head that moves in the main scanning direction, and causes light to be radiated from the light radiating section that moves in the main scanning direction and causes the lowermost layer to be cured after application of the first photocurable ink on the printing medium, wherein the lowermost layer is formed with N (N>=2) scanning operations, the radiation controller being configured to not radiate the lowermost layer with the light during scanning operations 1 to N, and after N scanning operations, the lowermost layer being radiated with the light after at least three seconds have elapsed from an end of applying the ink layer, and wherein, the radiation controller is configured to irradiate the image layer with light during each scanning operation of the plurality of scanning operations.

9. The printing apparatus according to claim 8, wherein the illuminance of light with which the lowermost layer is irradiated is the illuminance of light with which the ink layer is irradiated or less.

* * * * *